US008926346B2

(12) United States Patent
Hsu

(10) Patent No.: US 8,926,346 B2
(45) Date of Patent: Jan. 6, 2015

(54) POWER SUPPLY WITH ADJUSTABLE PLUG INSERTION DIRECTION

(71) Applicant: Powertech Industrial Co., Ltd., New Taipei (TW)

(72) Inventor: Jung-Hui Hsu, New Taipei (TW)

(73) Assignee: Powertech Industrial Co., Ltd., New Taipei (TW)

( * ) Notice: Subject to any disclaimer, the term of this patent is extended or adjusted under 35 U.S.C. 154(b) by 79 days.

(21) Appl. No.: 13/845,331

(22) Filed: Mar. 18, 2013

(65) Prior Publication Data

US 2014/0057488 A1 Feb. 27, 2014

(30) Foreign Application Priority Data

Aug. 24, 2012 (TW) ..... 101130785 A

(51) Int. Cl.

| | |
|---|---|
| ***H01R 13/44*** | (2006.01) |
| ***H01R 13/66*** | (2006.01) |
| ***H01R 9/24*** | (2006.01) |
| ***H01R 25/00*** | (2006.01) |
| *H01R 103/00* | (2006.01) |
| *H01R 24/78* | (2011.01) |

(52) U.S. Cl.

CPC ..... *H01R 13/6675* (2013.01); *H01R 9/2408* (2013.01); *H01R 25/003* (2013.01); *H01R 2103/00* (2013.01); *H01R 24/78* (2013.01)

USPC ..... 439/143; 439/224

(58) Field of Classification Search

USPC ..... 439/143, 224, 222, 142, 145, 218

See application file for complete search history.

(56) References Cited

U.S. PATENT DOCUMENTS

| | | | | |
|---|---|---|---|---|
| 4,584,430 | A * | 4/1986 | Belknap | 174/67 |
| 5,866,846 | A * | 2/1999 | Huag | 174/67 |
| 6,780,038 | B1 * | 8/2004 | Huang | 439/224 |
| 2007/0099458 | A1 * | 5/2007 | Gottstein | 439/142 |

* cited by examiner

*Primary Examiner* — Gary Paumen

(74) *Attorney, Agent, or Firm* — Li & Cai Intellectual Property (USA) Office

(57) ABSTRACT

The present invention discloses a power supply including a first conductive module, a second conductive module connected to the first conductive module, and a plurality of hollow sleeves. The first conductive module and the second conductive module respectively include a plurality of first clamping parts and second clamping parts, wherein a position of each second clamping part corresponds to one of first clamping parts. The hollow sleeves are housing around the first conductive module and the second conductive module. Each hollow sleeve includes at least one plug hole, and covers one of the first clamping parts and the corresponding second clamping part. When rotating the hollow sleeve, the plug hole selectively coincides with the first clamping part or the second clamping part, so that multiple fins of a plug are inserted into the first clamping part or the second clamping part through the plug hole.

10 Claims, 13 Drawing Sheets

POWER SUPPLY WITH ADJUSTABLE PLUG INSERTION DIRECTION

BACKGROUND OF THE INVENTION

1. Field of the Invention

The present invention relates to a power supply; in particular, to a power supply with adjustable plug insertion direction.

2. Description of Related Art

Each plug hole of the traditional power socket with multiple plug holes is on the front side of the power socket. In common condition, multiple plug holes of the traditional power socket can be used effectively; multiple plugs can be plugged into each plug hole of the power socket.

However, the electrical products in the markets now are always with the rectification transformer in order to transform the alternating current from the power source into the direct current which satisfies with the standard. Thus, the electrical products can operate. Furthermore, the rectification transformers for different electrical products not only have different output standards but also have different volumes and shapes.

Thus, when the user connects the rectification transformers into the traditional power socket, the rectification transformers with large volumes will cover the neighboring plug hole, so that other power plugs or rectification transformers cannot be plugged into the covered plug holes. The availability of this power socket will be decreased. There is rotation socket which can increase the availability of the power socket now. However, the rotation socket can only have two-holed plug holes due to the structure of the plug's grounding tab, so that the three-tabbed plug cannot be plugged into the rotation socket.

Plus, because the exposure design of the traditional power socket, the traditional power socket cannot shelter or insulate the plug holes not in use. The life time of the power socket will be decreased without the dust-proof ability. The chance of electrocution will also be increased.

SUMMARY OF THE INVENTION

The embodiment of the present invention provides a power supply with adjustable plug insertion direction, and the power supply is composed of multiple hollow sleeves which cover two connected conductive modules. Users can let one plug hole on the hollow sleeves coincides with one of the two conductive modules or between the two conductive modules. The plug insertion direction on the power supply can thus be altered.

The embodiment provides a power supply with adjustable plug insertion direction. The power supply compromises a first conductive module, a second conductive module, and multiple hollow sleeves. The first conductive module is connected to the second conductive module. The first conductive module comprises multiple first clamping parts. The second conductive module comprises multiple second clamping parts, and a position of each second clamping part corresponds to one of the first clamping parts. The hollow sleeves can be rotated to house around the first conductive module and the second conductive module, and the each hollow sleeve have at least one plug hole. When rotating one of the hollow sleeves, the plug hole selectively coincides with the first clamping part or the second clamping part, so that multiple fins of a plug are inserted into the first clamping part or the second clamping part through the plughole.

The embodiment provides a power supply with adjustable plug insertion direction. In the power supply, a conductor with clamping parts having multiple sides is formed through the connection of multiple conductive modules. The plug hole on the hollow sleeve can accordingly move to the clamping part to be used, and the multiple conductive fins of the plug can be inserted into the clamping part through the plug hole by rotating the hollow sleeve housing on the conductive modules. The present invention of the power supply not only can alter the insertion direction of the plug, but also has the characteristic that when the exterior shell moves, the interior conductor does not move. The reliability of the power supply can be increased without increasing much production costs.

For further understanding the present invention, the following embodiments are provided along with illustrations to facilitate the disclosure of the present invention.

DETAILED DESCRIPTION OF THE PREFERRED EMBODIMENTS

〔The Embodiment of the Power Supply〕

Figure 1A:
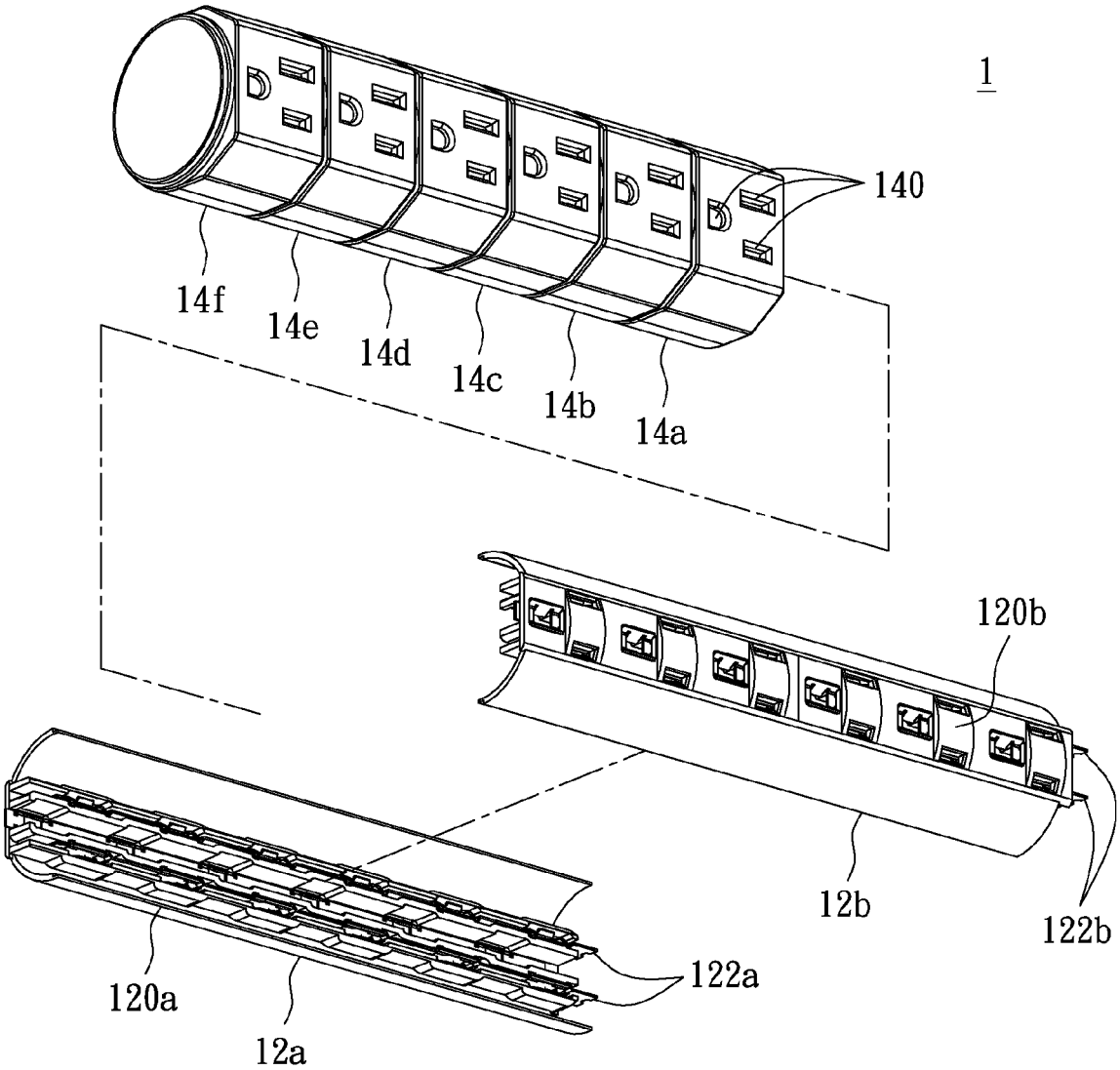
FIG. 1A is an explosion diagram of a power supply according to one embodiment of the invention.
Figure 2:
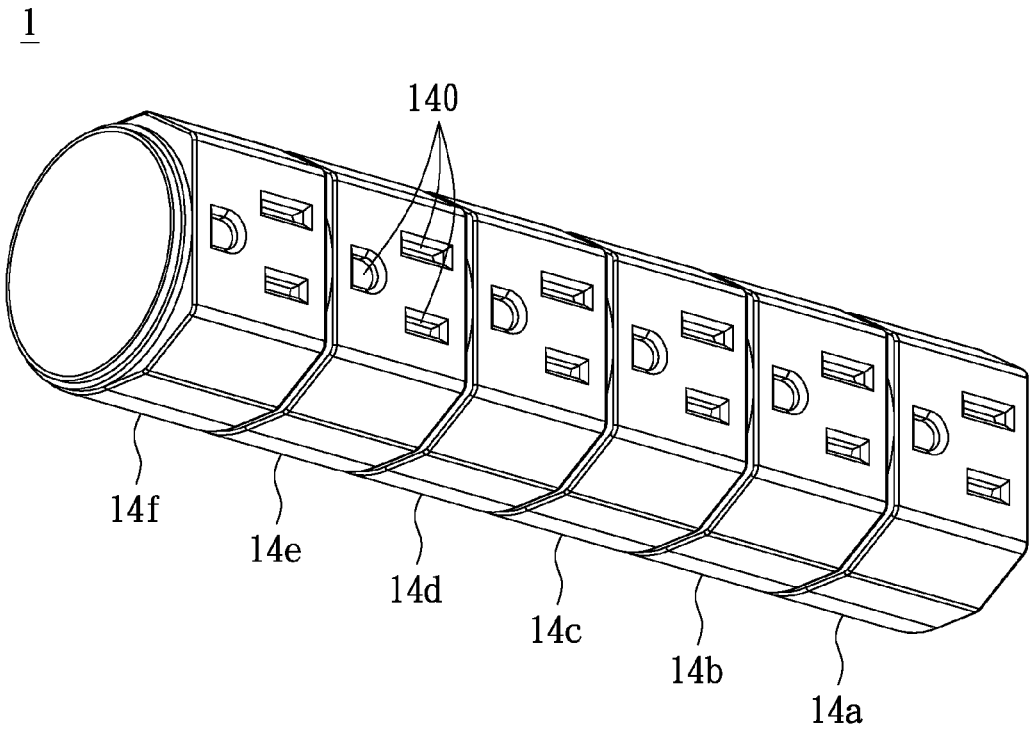
FIG. 2 is a stereogram of a power supply according to one embodiment of the invention.

Refer to FIG. 1A and FIG. 2A, FIG. 1A is an explosion diagram of a power supply according to one embodiment of the present invention, and the FIG. 2A is the stereogram of a power supply according to one embodiment of the present invention. As shown in FIG. 1A and FIG. 2A, the power supply 1 comprises two conductive modules 12*a* and 12*b* and a plurality of hollow sleeves 14*a*-14*f*. The following are the detailed explanations of the elements associated with the power supply 1.

The conductive module 12*a* (the first conductive module) and 12*b* (the second conductive module) respectively comprises multiple clamping parts 120*a* and 120*b*, each of them is used to trap the multiple conductive fins of the plug. The multiple clamping parts 120*a* (the first clamping part) and 120*b* (the second clamping part) are respectively connected to corresponding clamping parts to form the conductor 122*a* and 122*b*. Thus, from the upper faces of the conductive modules 12*a* and 12*b*, the clamping parts 120*a* are exposed in space on the upper face of the conductive module 12*a*, and the conductor 122*a* is substantially hidden under the upper face of the conductive module 12*a*. The multiple clamping parts 120*b* are exposed in space on the upper face of the conductive module 12*b*, and the conductor 122*b* is substantially hidden under the upper face of the conductive module 12*b*. The position and spacing of each clamping part 120*b* correspond to the setting manner of the clamping part 120*a*.

Furthermore, the conductive module 12*a* can be connected to the conductive module 12*b*, so that the hollow sleeves 14*a*-14*f* can cover the connected conductive modules 12*a* and 12*b*. The person with the ordinary skill in the art can design the conductive module 12*a* and the conductive 12*b* as the detachable connecting structure. Thus, the present invention does not limit the connection manner of the conductive module 12*a* and 12*b*.

The structure and the length of the spacing of the conductive module 12*b* are the same with the conductive module 12*a*. The person with the ordinary skill in the art can design the total length and inner structure of the conductive module 12*a* and 12*b*, or the spacing and numbers of the clamping parts 120*a* and 120*b* according to the practical conditions. Thus, the conductive modules 12*a* and 12*b* need not be the same, and the present invention is not limited thereto.

The conductors 122*a* and 122*b* can be one kind of metal conductive sheet, so that the multiple conductive fins which are plugged into the plugs of the clamping parts 120*a* or 120*b* can be connected to the fire wire, neutral wire and grounding wire of the power source. The conductors 122*a* and 122*b* can be connected and shared; for instance, because the conductors 122*a* and 12*b* are connected to the fire wire, neutral wire and grounding wire of the power source, the metal conductive sheet connected to the fire wire of the conductors 122*a* and 122*b* can be connected and shared, and the metal conductive sheets connected to the neutral wire and grounding wire can also be connected and shared. The conductors 122*a* and 122*b* are substantially physically connected.

Figure 1B:
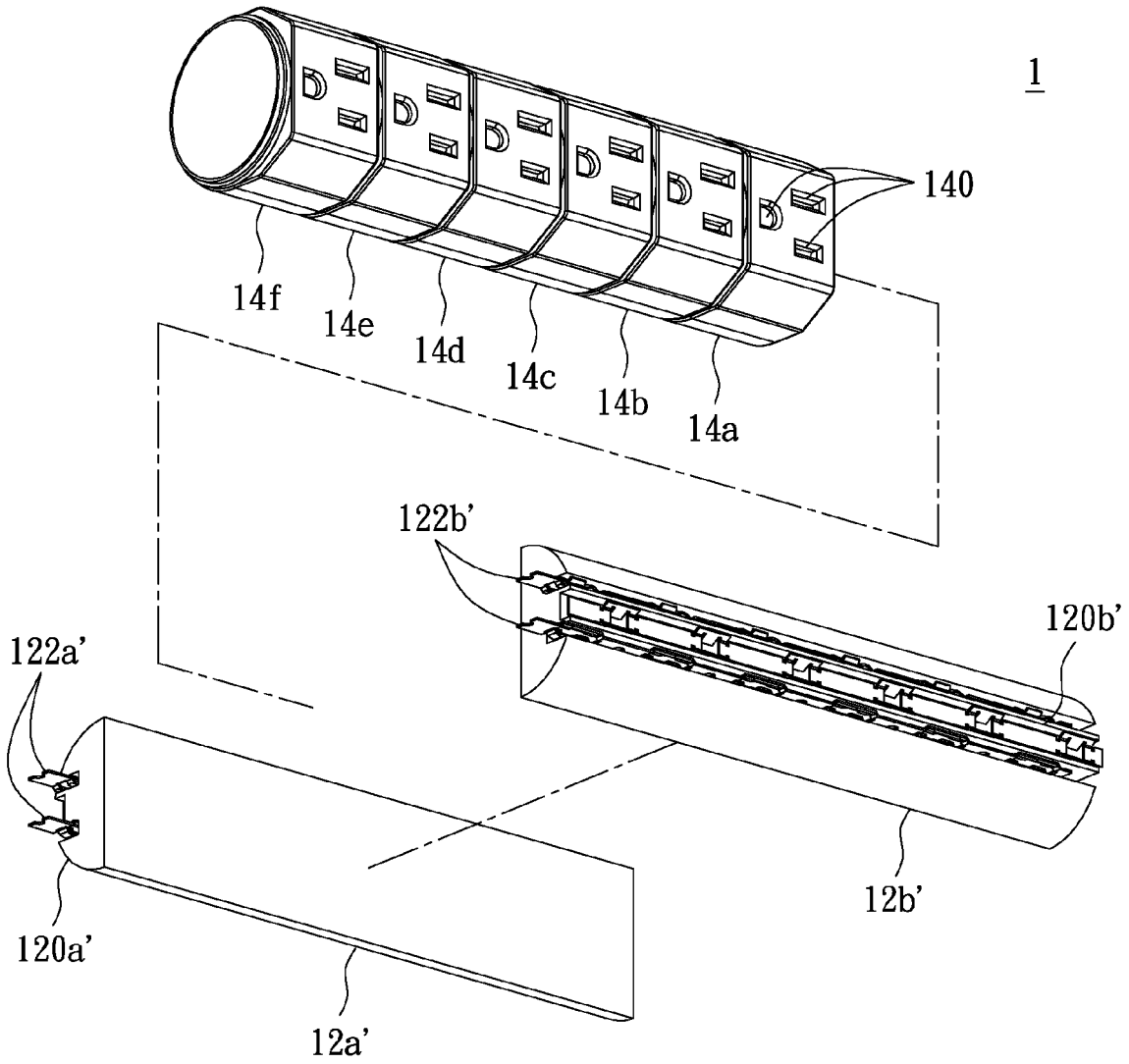
FIG. 1B is an explosion diagram of a power supply according to another embodiment of the invention.

Although the conductor 122*a* and the conductor 122*b* are respectively set in the interior of the conductive modules 12*a* and 12*b* as shown in FIG. 1A, the setting manners and positions of the conductors 122*a* and 122*b* of the invention are not limited to the above manners. Please refer to FIG. 1B, FIG. 1B is an explosion diagram of the power supply according to one embodiment of the invention. As shown in FIG. 1B, the conductive modules 12*a*' and 12*b*' also have multiple clamping parts 120*a*' and 120*b*', and the multiple clamping parts 120*a*' and 120*b*' are respectively connected to the corresponding clamping parts to form the conductors 122*a*' and 122*b*'. However, from the upper face of the conductive modules 12*a*' and 12*b*', the conductors 122*a*' and 122*b*' are exposed on the upper face of the conductive module 12*a*' and 12*b*', and the clamping parts 120*a*' and 120*b*' are respectively set in the conductors 122*a*' and 122*b*' in space.

The transverse profile diameter of the hollow sleeves 14*a*~14*f* are roughly larger than the largest transverse profile diameter of the connected conductive modules 12*a* and 12*b*. The hollow sleeves 14*a*~14*f* can house around the conductive module 12*a* and the conductive module 12*b*. The arrangement orientation of the multiple hollow sleeves 14*a*~14*f* are parallel to the stretching orientation of the conductors 122*a* and 122*b*. Each hollow sleeve 14*a*~14*f* covers at least one of the clamping parts and corresponds to one of the clamping parts 120*b*. Each hollow sleeve 14*a*~14*f* has at least one of the plug holes 140, and the holes of the plug hole 140 correspond to the multiple conductive fins of the plug in order to provide space for the conductive fins of the plug to insert into the conductive module 12*a* or 12*b*.

The person with the ordinary skill in the art can design the plug holes 140 of the hollow sleeves 14*a*~14*f* differently according to the practical condition of the power supply 1. For example, the plug holes 140 of the hollow sleeves 14*a*~14*f* can be designed as two-holed plug holes or three-holed plug holes, and the clamping parts 120*a* and 120*b* (or 120*a*' and 120*b*') of the conductive module 12*a* and 12*b* can be correspondingly designed to match the structures of the two-holed plug holes or three-holed plug holes.

Each plug hole 140 of the hollow sleeves 14*a*~14*f* stacks on clamping part 120*a* of the conductive module 12*a*. The clamping parts 120*a* of the conductive module 12*a* are conducted through the holes of the plug holes 140 of the hollow sleeves 14*a*~14*f*. Each clamping part 120*b* of the conductive module 12*b* is covered by the hollow sleeves 14*a*~14*f*. In the power supply 1, the conductive fins of the plugs can be connected to the clamping parts 120*a*, and the insertion directions of the plugs are the same.

Figure 3:
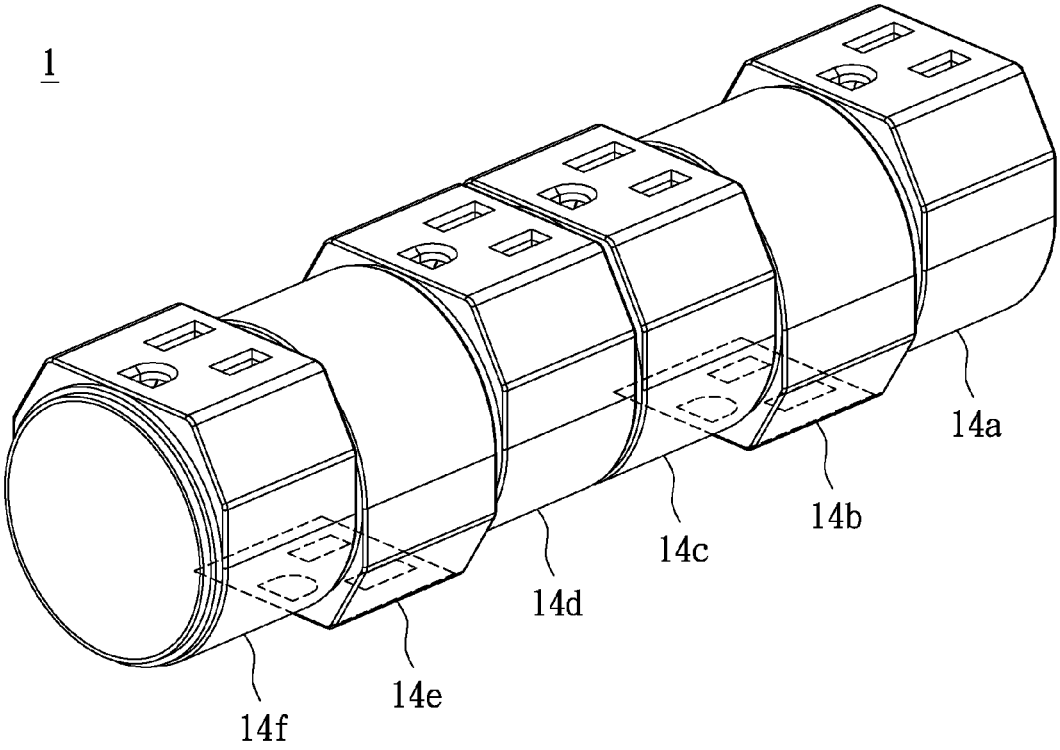
FIG. 3 is a stereogram of a power supply in use according to one embodiment of the invention.

Please refer to FIG. 3, FIG. 3 is a stereogram of a power supply in use according to one embodiment of the invention. As shown in FIG. 3, when the hollow sleeves 14*b* and 14*e* are being rotated, the plug holes 140 of the hollow sleeves 14*b* and 14*c* can coincide with the corresponding clamping parts 120*b*. Thus, the insertion direction of the plugs can be altered. By rotating the hollow sleeves, the plug holes of the hollow sleeves 140 can selectively coincides with the clamping parts 120*a* or 120*b* corresponding to this hollow sleeve, so that multiple conductive fins of the plug are inserted into the first clamping part or the second clamping part through the plug hole.

In the power supply 1, the hollow sleeves 14*a*~14*f* are housing around the connected conductive modules 12*a* and 12*b*. When the conductive fins of the plug are inserted into the clamping part corresponding to this hollow sleeve through the plug hole 140 of the hollow sleeve, the hollow sleeve cannot rotate because the hollow sleeve has already been inserted with the plug. If the direction of this plug hole 149 of the hollow sleeve needs to be altered, the multiple conductive fins of the plug need to be detached from the clamping part in order to let hollow sleeve be rotated. From the structure, this power supply 1 has the structure that the outer cover moves but the inner conductor does not move.

Although the clamping parts 120*a* and 120*b* of this invention corresponds to three-holed plug holes, this invention is not limited thereto. The clamping parts 120*a* and 120*b* can also correspond to the two-holed plug holes, or the universal serial bus (USB) connection ports. The number of the conductive modules, the space and number of the clamping parts on the conductive modules are not used to limit this invention, and the person with an ordinary skill in the art can design the structures of the clamping parts 120*a* and 120*b* according to demanded requirements. For instance, the conductive modules 12*a* and 12*b* of the power supply 1 can be designed to have one clamping part 120*a* and 120*b*. The hollow sleeve 14 houses around the connected conductive module 12*a* and 12*b*, so that the plug holes 140 of the hollow sleeves 14 selectively coincides with the clamping parts 120*a* or 120*b*.

〔Another Embodiment of the Power Supply〕

Figure 4:
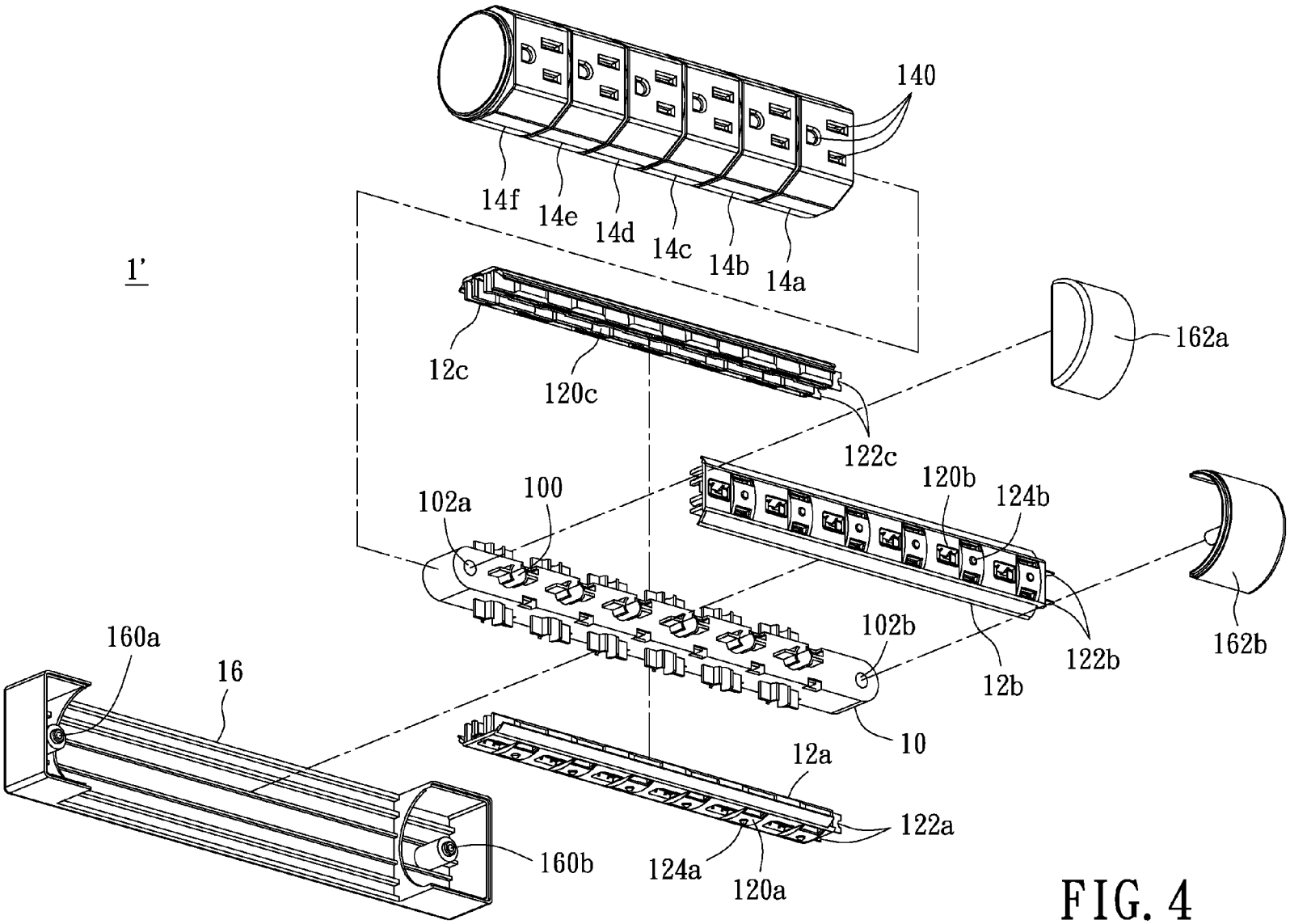
FIG. 4 is an explosion diagram a power supply according to another embodiment of the invention.
Figure 5:
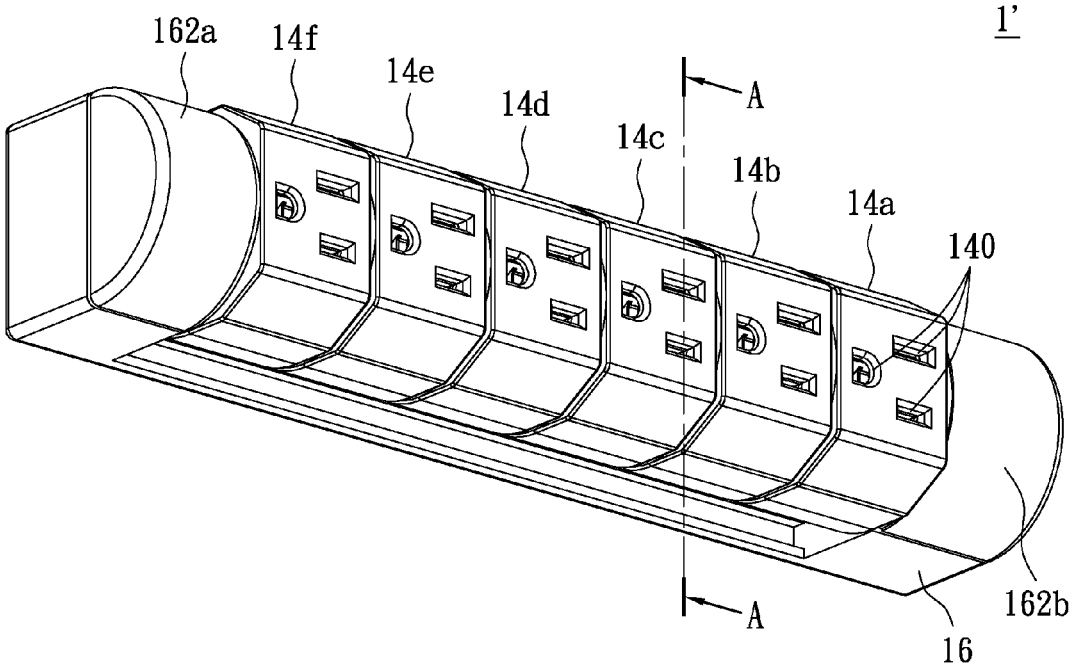
FIG. 5 is a stereogram of a power supply according to another embodiment of the invention.

Please refer to FIG. 4 and FIG. 5, FIG. 4 is an explosion diagram a power supply according to another embodiment of the invention, and FIG. 5 is a stereogram of a power supply according to another embodiment of the invention. As shown in FIG. 4 and FIG. 5, the power supply 1' further comprises a pillar 10, conductive modules 12*a*, 12*b*, and 12*c*, hollow sleeves 14*a*~14*f* and a base 16. Because units of this power supply 1' are the same with those of the previous power supply 1, the effects and actions of the same components are not stated again here.

The differences between the previous power supplies 1 and 1' are that the power supply 1' of this embodiment further comprises a pillar 10 to fix the conductive modules 12*a*, 12*b*, and 12*c*; thus, the conductive modules 12*a*, 12*b*, and 12*c* connected to the surface of the pillar 10 are detachable. For practical use, the pillar 10 is a multi-side cylinder, and at least one connection unit 100 is set on the upper face of the pillar 10, wherein the connected conductive modules 12*a*, 12*b*, and 12*c* are connected on the upper surface. Besides, the design of the connection unit 100 corresponds to the design of the conductive modules 12*a*, 12*b*, and 12*c*. Thus, the connection unit 100 can be connected to the conductive modules 12*a*, 12*b*, and 12*c*.

For instance, if the structure of the connection unit is a convex structure, the position of the pillar 10 that the conductive modules 12*a*, 12*b*, and 12*c* connect to is a concave structure. On the contrary, if the structure of the connection unit 100 is a concave structure, the position of the pillar 10 that the conductive modules 12*a*, 12*b*, and 12*c* connect to is a convex structure. Through the above manner, the conductive modules 12*a*, 12*b*, and 12*c* connected to different sides of the pillared 10 are detachable.

Furthermore, there are engagement portions 102*a* and 102*b* set on the two corresponding ends of the pillar 10; thus, the engagement portions 102*a* and 102*b* can be correspondingly fastened to the engagement portions 160*a* and 160*b* of the base 16. The pillar 10 can be fixed on the base 16 with the stationary hood 162*a* and 162*b*. The base 16 is used to fix the pillar 10 which is connected to the conductive modules 12*a*, 12*b*, and 12*c* and is housed by the multiple hollow sleeves 14*a*~14*f*. In the power supply 1', the engagement portions 102*a* and 102*b* are set correspondingly on the engagement portions 160*a* and 160*b* of the base 16, and the stationary hood 162*a* and 162*b* coincides with the engagement portions 160*a* and 160*b* of the base 16 as shown in FIG. 5.

For practical use, the engagement portions 102*a* and 102*b* of the pillar 10 can be a two-side pore structure, and the engagement portions 160*a*, 160*b* of the base 16 and the stationary hood 162*a* and 162*b* are correspondingly columnar structure. The engagement portions 160*a*, 160*b* and the stationary hood 162*a*, 162*b* of the base 16 can insert through the engagement portions 102*a* and 102*b* of the pillar 10 in order to let the pillar 10 be set on the base 16. However, the fixing manner of the pillar 10 is not limited in this invention, and the person with an ordinary skill in the art can also design the engagement portions 102*a*, 102*b* of the pillar 10 as a convex structure and correspondingly design the engagement portions 160*a*, 160*b* and the stationary hood 162*a*, 162*b* as the engagement slot structure which can accommodate this convex structure.

The surface of the conductive modules 12*a*, 12*b* and 12*c* in this embodiment further comprise multiple positioning units 124*a*, 124*b*, and 124*c* (124*c* is not shown in FIG. 4), and the positioning units 124*a*, 124*b*, and 124*c* is respectively set on the surface of each conductive module 12*a*, 12*b*, and 12*c*. Thus, the hollow sleeves 14*a*~14*f* housed around the pillar 10 and the conductive modules 12*a*, 12*b*, 12*c* can be rotated in stage.

Figure 6:
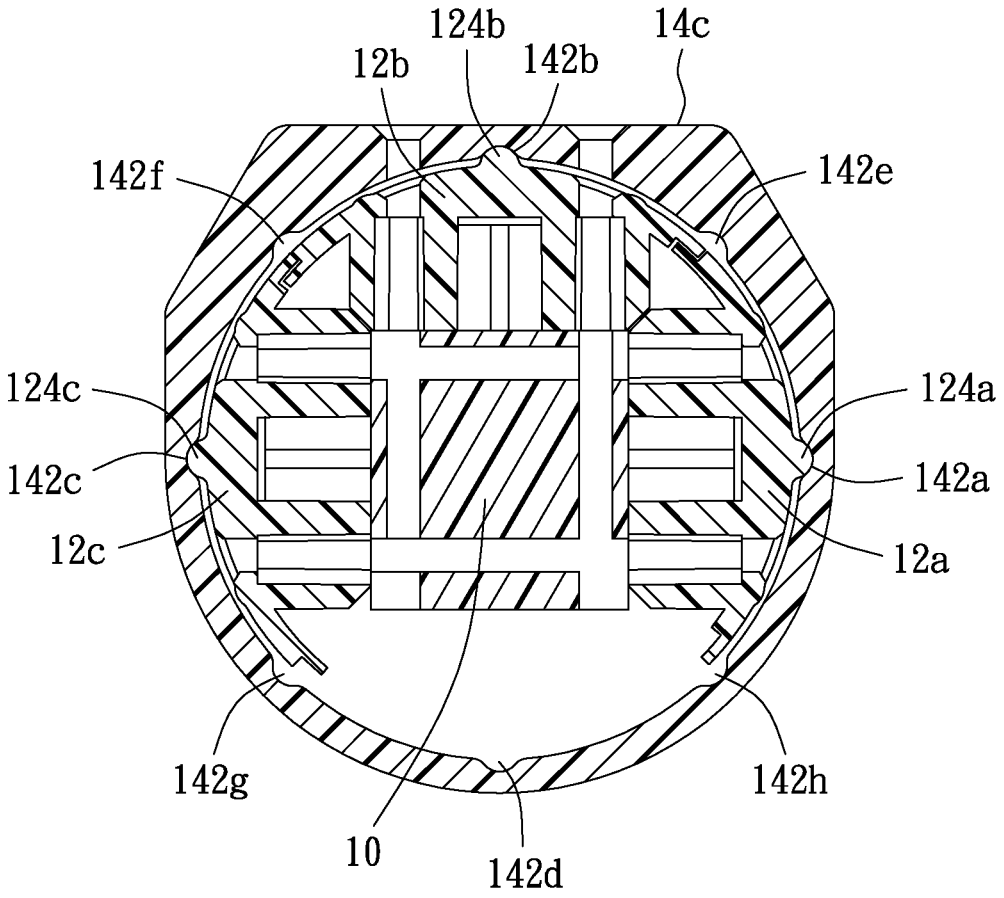
FIG. 6 is a cross-sectional view along a line AA of a power supply according to another embodiment of the invention.

Moreover, the hollow sleeves 14*a*~14*f* must be designed as the stuck structure which corresponds to the positioning units 124*a*, 124*b*, and 124*c*; thus, the hollow sleeves 14*a*~14*f* can be rotated in stage. Please refer to FIG. 6, FIG. 6 is a cross-sectional view along a line AA a power supply according to another one embodiment of the invention. As shown in FIG. 6, the inner wall of the hollow sleeve 14*c* comprises multiple stuck components 142*a*~142*h*, and these stuck components form in space on the inner wall of the hollow sleeve 14*c*. Besides, the structure of each stuck component 142 corresponds to the positioning units 124*a*, 124*b*, and 124*c* on the surface of the conductive modules 12*a*, 12*b*, and 12*c*.

For practical use, the positioning units 124*a*, 124*b*, and 124*c* on the surface of the conductive modules 12*a*, 12*b*, and 12*c* can be a convex point, and the stuck components 142*a*~142*h* on the surface of the hollow sleeves 14*a*~4*f* are correspondingly the concave slots. Through the above manner, the hollow sleeves can be stuck in the positioning units 124*a*, 124*b*, and 124*c* with resistance. If the corresponding direction of the plug hole 140 direction needs to be altered, the hollow sleeve 14 should be rotated with the force so that the plug hole can be changed to the desired direction.

The inner wall of the hollow sleeve requires at least four stuck components (142*a*~142*d*), so that the four stuck components (142*a*~142*d*) of the hollow sleeve 14*c* can stuck the positioning units 124*a*, 124*b*, and 124*c* in stage. Besides, there are the stuck components 142*e*~142*h* between the stuck components 142*a*~142*d*, so that the angle between two adjacent stuck components is 45 degrees.

Furthermore, this invention does not limit whether there are positioning units 124*a*, 124*b*, and 124*c* on the surface of the conductive modules 12*a*, 12*b*, and 12*c*. For instance, if the positioning units 124*b* are only on the surface of the conductive modules 12*b*, and the conductive modules 12*a* and 12*c* comprise a flat surface, the positioning unit 124*b* can selectively stuck the stuck components 142*a*~142*h* of the hollow sleeves 14*a*~14*f* through the stuck components 142*a*~142*h* on the inner wall of the hollow sleeve 14. Thus, the plugs can also be altered to the desired direction.

Figure 7:
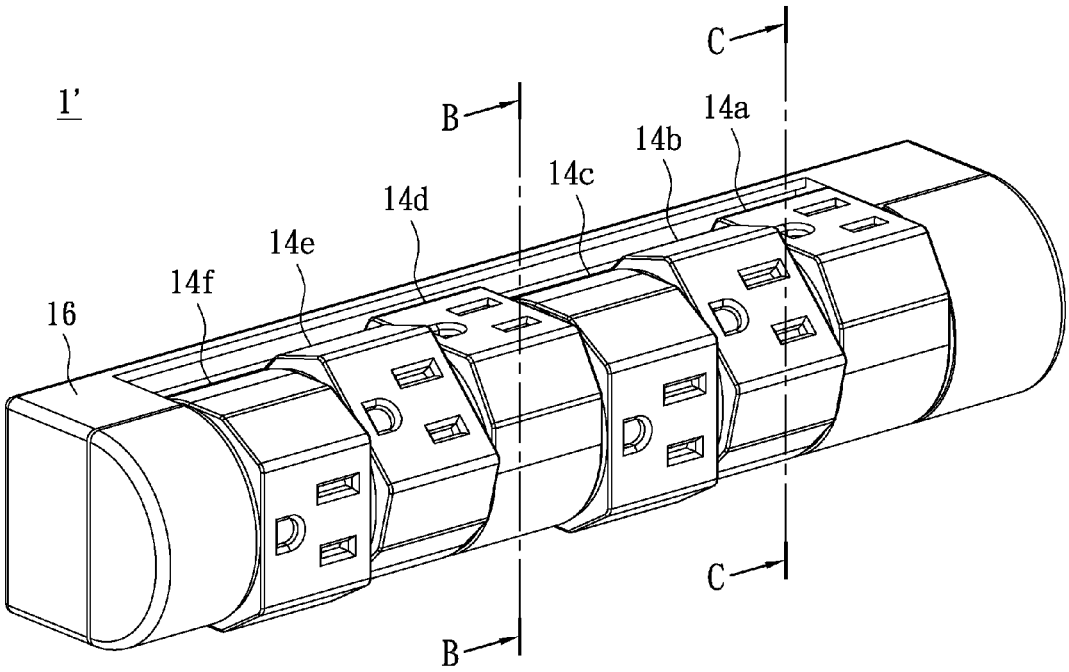
FIG. 7 is a stereogram of a power supply in use according to another embodiment of the invention.

To further explain the corresponding relationship between the stuck components 142*a*~142*h* of each hollow sleeve and the positioning units 124*a*, 124*b*, 124*c* of the conductive modules 12*a*, 12*b*, 12*c*, when the hollow sleeve rotates, please refer to FIG. 7. FIG. 7 is a stereogram of a power supply in use according to another one embodiment of the invention.

As shown in FIG. 7, the hollow sleeves 14*a*~14*f* can alter the coinciding position of the plug holes 140; for instance, the plug holes of the hollow sleeves 14*c* and 14*f* coincide on the clamping part 120*b* which corresponds to the conductive module 12*b*. Through the above manner, multiple conductive fins of a plug are inserted into the clamping part which corresponds to the plug hole 140 through the plug hole 140.

The plug holes 140 of the hollow sleeves 14*b* and 14*c* coincide between the conductive modules 12*b* and 12*c*. Through this, the plug holes 140 of the hollow sleeves 14*b* and 14*c* cannot form a connected space with the clamping parts 120 of any conductive modules 12, so that the plug cannot be inserted into the clamping part 120 which is masked by the hollow sleeve 14*b* and 14*e*.

Figure 8A:
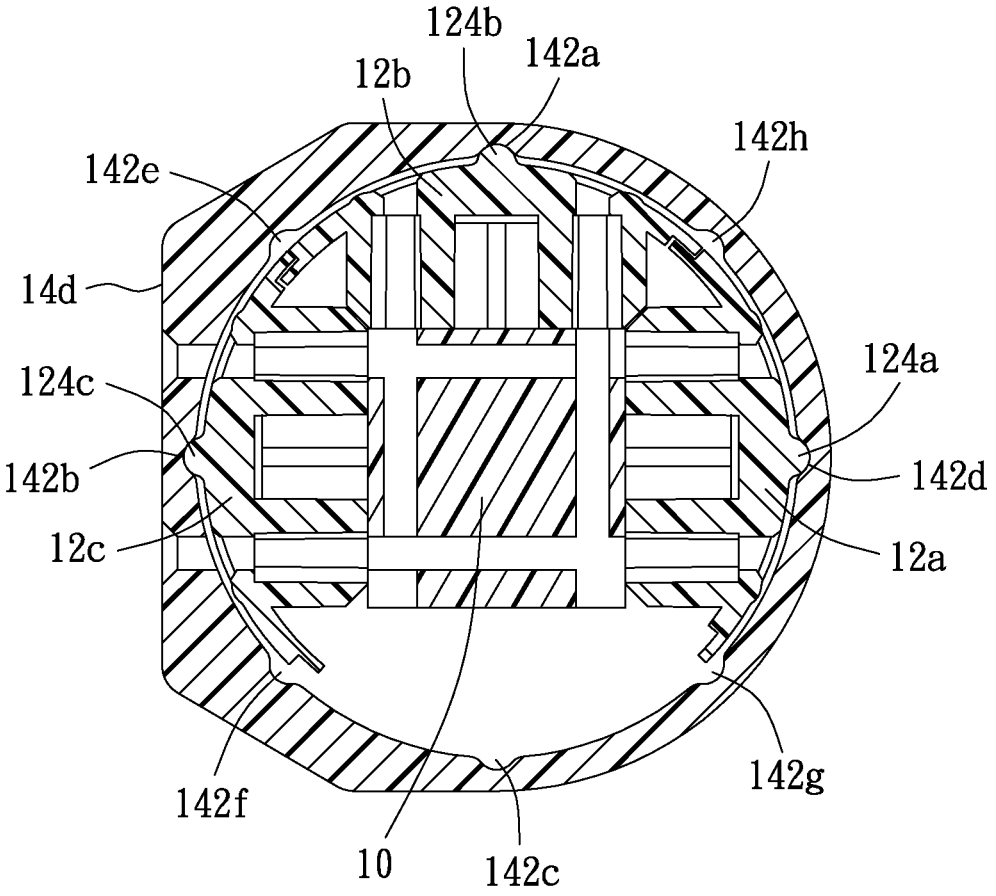
FIG. 8A is a cross-sectional view along a line BB of a power supply according to another embodiment of the invention.
Figure 8B:
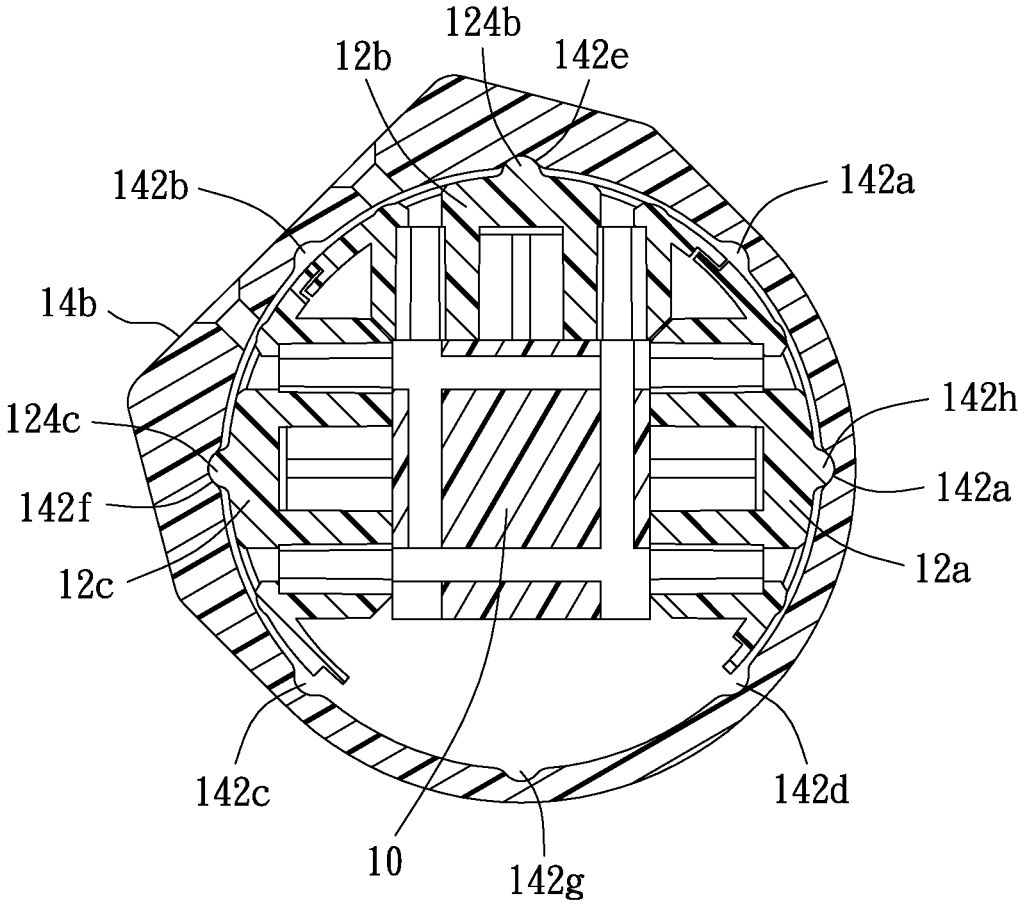
FIG. 8B is a cross-sectional view along a line CC of a power supply in use according to another embodiment of the invention.

To further explain the actions of the power supply 1' inner structures in use, please refer to FIG. 8A and FIG. 8B. FIG. 8A is a cross-sectional view along a line BB of a power supply in use according to another one embodiment of the invention; FIG. 8B is a cross-sectional view along a line CC of a power supply in use according to another embodiment of the invention.

As shown in FIG. 8A, the plug holes 140 of the hollow sleeve 14*d* coincides with the clamping part 120*c* of the conductive module 12*c*. From the transverse view, the stuck components 142*d*, 142*a*, 142*b* of the hollow sleeve 14*f* respectively stuck on the positioning units 124*a*, 124*b*, 124*c* of the conductive modules 12*a*, 12*b*, 12*c*. Thus, multiple conductive fins of a plug are inserted into the clamping part 120*c* of the conductive module 12*c* through the plug holes 140. Naturally, the hollow sleeve 14*d* can be rotated 90 degrees clockwise so that the stuck components 142*a*, 142*b*, and 142*c* can respectively stuck on the positioning units 124*a*, 124*b*, and 124*c* of the conductive modules 12*a*, 12*b*, and 12*c* (As shown in FIG. 6). Thus, multiple conductive fins of a plug are inserted into the clamping part 120*b* of the conductive module 12*b* through the plug holes 140.

As shown in FIG. 8B, the plug holes 140 of the hollow sleeve 14*b* coincide between the conductive modules 12*b* and 12*c*. From the transverse view, the stuck components 142*h*, 142*e*, 142*f* of the hollow sleeve 14*f* respectively stuck on the positioning units 124*a*, 124*b*, 124*c* of the conductive modules 12*a*, 12*b*, 12*c*. The hollow sleeve 14*b* can be rotated 45 degrees clockwise so that the stuck components 142*a*, 142*b*, and 142*c* can respectively stuck on the positioning units 124*a*, 124*b*, and 124*c* of the conductive modules 12*a*, 12*b*, and 12*c* (As shown in FIG. 6). Thus, multiple conductive fins of a plug cannot be inserted into the clamping parts 120*a*, 120*b*, 120*c*.

For practical use, in order to accommodate the three-fined plug, there are often grounding conductive sheet in the inner part of the pillared 10, so that when the plug is connected to any clamping part of any conductive module, the grounding fins of the plug can be connected to this grounding conductive sheet. Furthermore, the power supply 1' of this embodiment does not limit the number of the positioning units 124 and stuck components 142, the person with an ordinary skill in the art can design a power supply 1' for their needs according to desired rotation angle of the hollow sleeve 14.

〔Another Embodiment of the Power Supply〕

Figure 9:
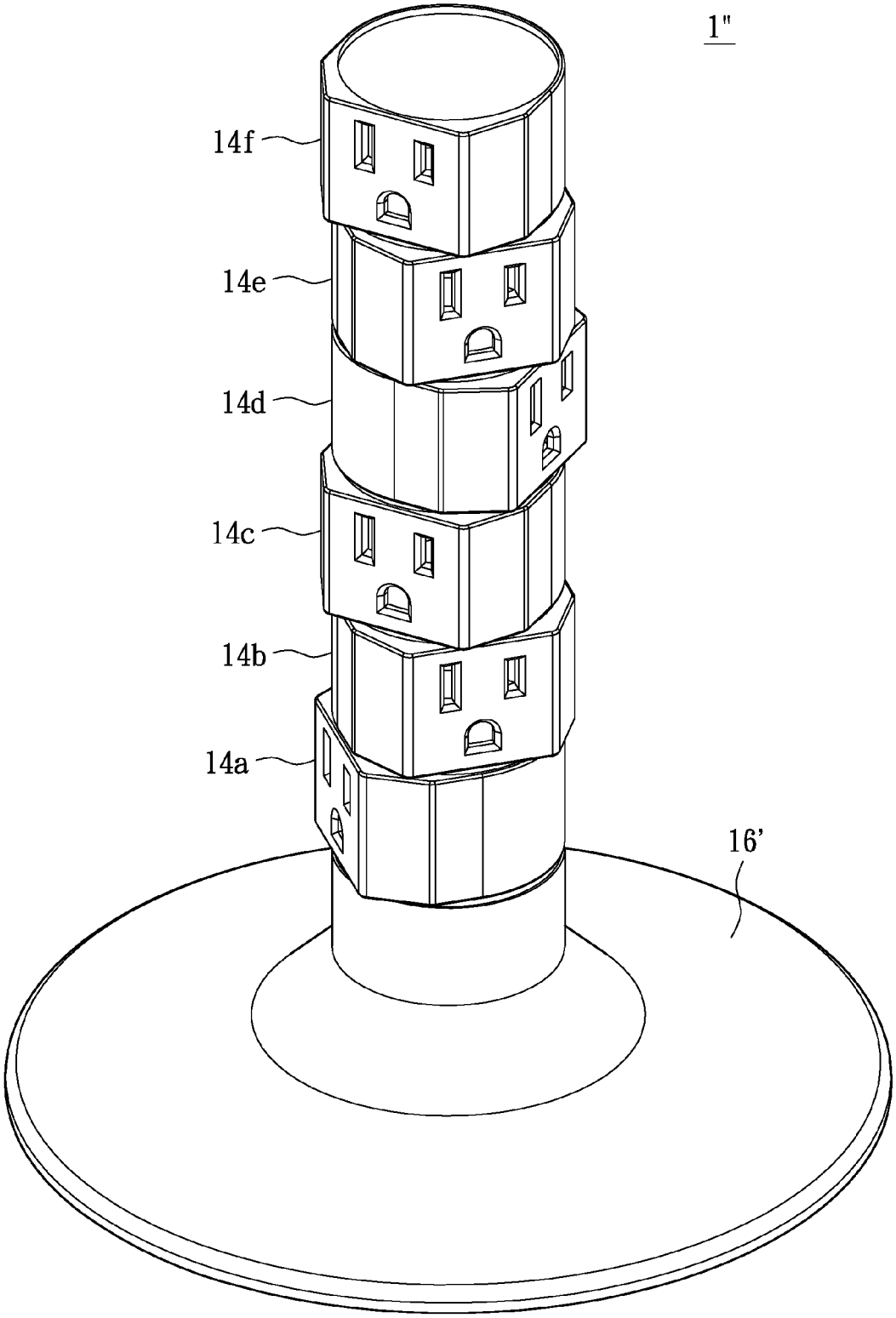
FIG. 9 is a stereogram of a power supply according to another embodiment of the invention.

Please refer to FIG. 9, FIG. 9 is a stereogram of a power supply in use according to another one embodiment of the invention. As shown in FIG. 9, the difference between the power supply 1" and the power supply 1' of the previous embodiment is that the base 16' of the power supply 1" is designed as transverse-profile design to sustain the hollow sleeves 14*a*~14*f*. That is, the extending direction of the pillar 10 of the power supply 1" is normal to the plane which the base 16' is set on. Thus, the rotation direction of the hollow sleeve 14*a*~14*f* is parallel to this plane. On the other hand, the extending direction of the pillar 10 of the previous power supply 1' is parallel to the plane which the base 16 is set on. Thus, the rotation direction of the hollow sleeve 14*a*~14*f* is normal to this plane.

Figure 10A:
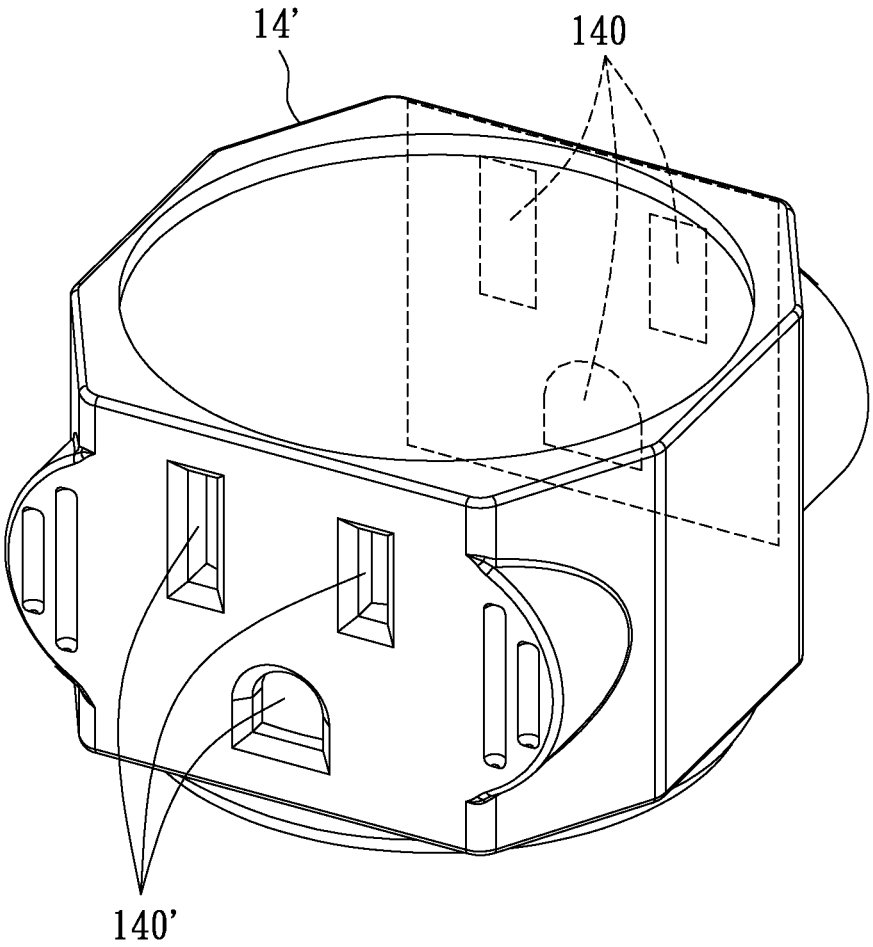
FIG. 10A is a structure diagram depicting a two-holed structure of a hollow sleeve according to one embodiment of the invention.

Furthermore, due to the design of the base 16' of the power supply 1", the insertion direction of the plug will not be blocked by the plane which the base 16' is set on; the plug thus can insert successfully. The conductive modules can be connected to each side of the pillar 10, so that the insertion direction of the plug can be more flexible. To make good use of the insertion direction of the power supply 1", each hollow sleeve can be designed as two-holed structure. Please refer to FIG. 10A, FIG. 10A is a structure diagram which depicts a two-holed structure of a hollow sleeve according to one embodiment of the invention. As shown in FIG. 10A, the hollow sleeve 14' comprises not only the original plug holes 140 but also another plug hole 14'. Furthermore, the position of the plug holes 140 corresponds to the position of the plug holes 140' on the hollow sleeve.

Figure 10B:
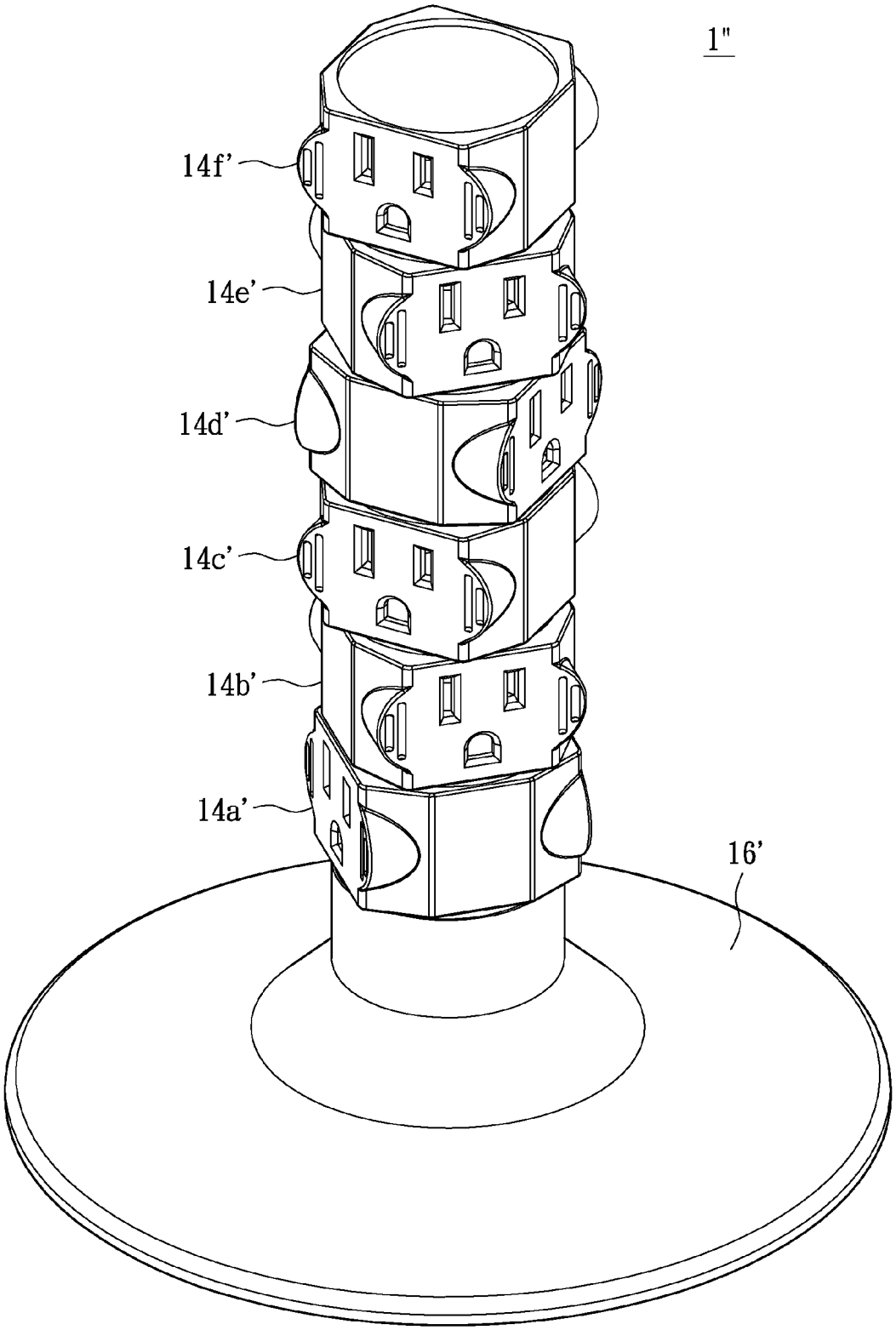
FIG. 10B is a stereogram of a power supply with the hollow sleeve according to FIG. 10A.

Please refer to FIG. 10B, FIG. 10B is a stereogram of a power supply with the hollow sleeve in use according to FIG. 10A. As shown in FIG. 10B, each hollow sleeve 14*a'*~14*f'* comprises the plug holes 140 and 140'. The power supply 1" thus can be altered according to the desired insertion direction of the plug, and the number of the plugs connected to this power supply 1" can also be doubled. The power supply 1" can thus be used efficiently.

Moreover, the position of the plug holes 140 and 140' on the hollow sleeve 14' are not limited in this present invention. The person with ordinary skill in the art can alter the above positions according to the cross-sectional area of the pillar. For instance, when the cross-sectional area of the pillared is large enough so that the conductive fins of the two plugs will not touch each other when connected to two adjacent conductive modules, the plug holes 140 and 140' of the hollow sleeve 14' can correspond to the clamping parts of the two adjacent conductive modules.

POSSIBLE EFFECTS OF THE EMBODIMENT

The embodiment of the invention offers a power supply with adjustable plug insertion direction. In the power supply, a conductor with clamping parts having multiple sides is formed through the connection of multiple conductive modules. The plug holes of the hollow sleeves can move correspondingly to the desired clamping parts, and multiple conductive fins of the plug can be inserted into the clamping part through this inserting hole through rotating the hollow sleeve which is housed around this conductive structure. Thus, this power supply not only can alter the insertion direction of the plug but also has the characteristic that when the outer shell moves the inner conductor does not move due to the simple design of inner structure. The reliability of this power supply can thus be increased without too much increase of production cost.

The descriptions illustrated supra set forth simply the preferred embodiments of the present invention; however, the characteristics of the present invention are by no means restricted thereto. All changes, alternations, or modifications conveniently considered by those skilled in the art are deemed to be encompassed within the scope of the present invention delineated by the following claims.

What is claimed is:

1. A power supply with adjustable plug insertion direction, comprising:

a first conductive module, comprising multiple first clamping parts;

a second conductive module, connected to the first conductive module, comprising multiple second clamping parts, and a position of each second clamping part corresponds to one of the first clamping parts; and multiple hollow sleeves, extending around the first conductive module and second conductive module, each of the hollow sleeves covers one of the first clamping parts and the second clamping part corresponding to the first clamping part, and each hollow sleeve comprises at least one plug hole, when rotating the hollow sleeve, the plug hole selectively coincides with one of the corresponding first clamping parts or one of the corresponding second clamping parts, multiple blades of a plug correspond to one first clamping part or one second clamping part, so that multiple blades of the plug are inserted into one of the first clamping parts or one of the second clamping parts through the plug hole.

2. The power supply with adjustable plug insertion direction according to claim 1, wherein the first conductive module and the second conductive module respectively comprises at least one first positioning unit and at least one second positioning unit, when rotating the hollow sleeve to be stuck on the first positioning unit, the plug hole coincides with one of the corresponding first clamping parts, and when rotating the hollow sleeve to be stuck on the second positioning unit, the plug hole coincides with one of the corresponding second clamping parts.

3. The power supply with adjustable plug insertion direction according to claim 2, wherein an inner side of each hollow sleeve comprises at least one first sticking component and at least one second sticking component, and a structure of the first sticking component corresponds to a structure of the first positioning unit, a structure of the second sticking component corresponds to a structure of the second positioning unit, so that the hollow sleeve rotates in stages.

4. The power supply with adjustable plug insertion direction according to claim 3, wherein the hollow sleeve further comprises at least one third sticking component between the first sticking component and the second sticking component, and a structure of the third sticking component corresponds to the structures of the first and second positioning units, when rotating the hollow sleeve to let the third sticking component be stuck on the first positioning unit or the second positioning unit, the plug hole moves to a position between one of the first clamping parts and one of the second clamping parts which corresponds to the hollow sleeve.

5. The power supply with adjustable plug insertion direction according to claim 1, wherein each first clamping part is connected to at least one first conductive sheet, and each second clamping part is connected to at least one second conductive sheet.

6. The power supply with adjustable plug insertion direction according to claim 5, wherein the multiple hollow sleeves are arranged parallel to the first conductive sheet and the second conductive sheet.

7. The power supply with adjustable plug insertion direction according to claim 1, further comprising a pillar with multiple sides, and the first conductive module and the second conductive module detachably connected to the different sides of the pillar.

8. The power supply with adjustable plug insertion direction according to claim 7, further comprising a base, wherein the pillar further comprises at least one first engagement portion coinciding with the at least one second engagement portion of the base, so that the pillar is fixed on the base.

9. The power supply with adjustable plug insertion direction according to claim 8, wherein the base is set on a plane, when an extending direction of the pillar is orthogonal to the plane, a rotation direction of the hollow sleeve is parallel to the plane.

10. The power supply with adjustable plug insertion direction according to claim 8, wherein the base is set on a plane, when an extending direction of the pillar is parallel to the plane, the rotation direction of the hollow sleeve is orthogonal to the plane.

* * * * *